United States Patent [19]

Reed

[11] Patent Number: 4,997,222

[45] Date of Patent: Mar. 5, 1991

[54] ZIPPER PULL

[75] Inventor: Evelyn E. Reed, Tulsa, Okla.

[73] Assignee: Troy Reed, Tulsa, Okla. ; a part interest

[21] Appl. No.: 470,106

[22] Filed: Jan. 25, 1990

[51] Int. Cl.[5] ..... A44B 19/24

[52] U.S. Cl. ..... 294/3.6; 24/429

[58] Field of Search ..... 294/1.1, 2, 3.6, 5, 294/9, 12, 14, 15, 19.1, 23.5, 24, 26, 50.5, 61, 92, 99, 121; 24/3 R:3 D, 3 K, 3 M, 112, 230.5 R, 230.5 W, 230.5 TP, 381, 385, 390, 391, 429, 709, 710; 81/3.45; 223/111; 16/114 R, 120; 403/229

[56] References Cited

U.S. PATENT DOCUMENTS

| | | | |
|---|---|---|---|
| 112,959 | 3/1871 | Raymond | 294/121 X |
| 137,622 | 4/1873 | Ragan | 294/121 X |
| 330,974 | 11/1885 | Friedmann et al. | 81/3.45 |
| 407,883 | 7/1889 | Wilder et al. | 294/19.1 X |
| 806,096 | 12/1905 | Bass | 294/92 X |
| 1,613,390 | 1/1927 | Gillette | 24/3 K |
| 1,924,451 | 8/1933 | McClarkey | 294/2 X |
| 2,084,617 | 6/1937 | Kehl | 294/19.1 X |
| 2,597,400 | 5/1952 | Stogsdill et al. | 294/26 X |
| 2,663,588 | 12/1953 | Sheldorfer | 294/3.6 |
| 2,928,157 | 3/1960 | Deering | 294/3.6 |
| 3,145,041 | 8/1964 | Grolig | 294/3.6 |
| 3,433,521 | 3/1969 | Lasko | 294/19.1 |
| 3,706,154 | 12/1972 | Luebbers et al. | 294/26 X |

FOREIGN PATENT DOCUMENTS

| | | | |
|---|---|---|---|
| 317856 | 2/1935 | Italy | 294/3.6 |
| 120960 | 6/1927 | Switzerland | 294/26 |
| 280648 | 11/1927 | United Kingdom | 81/3.45 |
| 836223 | 6/1960 | United Kingdom | 294/3.6 |

*Primary Examiner*—Johnny D. Cherry

*Attorney, Agent, or Firm*—Head & Johnson

[57] ABSTRACT

A device for opening and closing a slide fastener or zipper which has a pull tab with an aperture through it consists of an elongated shaft with a spiralled end, preferably wound about the longitudinal axis of the shaft. The spiralled winding preferably extends about an extension of this axis but may alternatively wind about the shaft itself. The winding is spirally insertable into and removable from the aperture in the pull tab. The spiral may be helical rather than tapered. The coils of the winding may be tapered toward the tip of the helical end of the shaft so as to maximize the coupling effect between the coils and the apertured tab. A spherical tip may be provided at the end of the coils to further prevent the possibility of snagging. The other end of the shaft may include a semi-circular extension adapted to removably suspend the device from a clothes rod. Alternatively, the other end of the shaft may include a slotted extension for facilitating manipulation of the device with the fingers.

19 Claims, 2 Drawing Sheets

ZIPPER PULL

BACKGROUND OF THE INVENTION

This invention relates generally to slide fasteners and more particularly concerns devices facilitating the operation of such fasteners.

With the introduction of the zipper to the back of women's clothing, a designer principle seems to have been simultaneously advanced as follows: "The pull tab of the slide fastener must always be out of reach." The resulting frustration has generated a multitude of responsive devices.

Most of these incorporated some form of hook connected to the end of a cord or rod or the like so that, when the hook was inserted in the aperture of the pull tab on the zipper slide, the user could pull up or down on the extension to close or open the zipper. However, open ended hook arrangements were often found to be more frustrating than the original problem because of the difficulty in keeping the hook engaged with the tab. Without constant tension on the extension, the hook slips out of the tab, leaving the user with the more frustrating task of trying to reengage the hook in a tab which was inaccessible in the first place.

Given this new difficulty, devices including moving parts for detachably connecting the hook to the tab were tried. While they generally solved the problem of the easily releasing hook, they created the added inconvenience of complicated manipulation in connecting and disconnecting the hook and tab. Furthermore, they made the zipper pull device comparatively more expensive, complicated and breakable.

Another problem with the open hook devices was that they frequently caught or snagged the user's clothing, making them awkward to use and sometimes causing damage to the apparel. As a result, such devices were sometimes provided with various types of shields to prevent the hook from catching on the apparel or even the skin of the user. These adaptations also further complicated the structure and operation of the device.

When not in use, if these complex devices were stored in a convenient place such as a closet or drawer where apparel was also stored, they tended to catch or snag the stored apparel. The cord type devices also tended to tangle in their own parts.

Accordingly, it is an object of this invention to provide a zipper pull having no moving parts. It is another object of this invention to provide a zipper pull which will not catch in or snag the user's apparel or skin. A further objective of this invention is to provide a zipper pull which may be easily and rapidly attached to and detached from a zipper pull tab. However, it is also an object of this invention to provide a zipper pull which will not inadvertently be detached from a zipper pull tab after it has been attached. Another object of the invention is to provide a zipper pull that is adapted to be easily and conveniently stored when not in use. A further object of this invention is to provide a zipper pull which consists of a single piece construction.

SUMMARY OF THE INVENTION

In accordance with the invention a device is provided for opening and closing a slide fastener or zipper which has a pull tab with an aperture through it. The device consists of a shaft with a spiralled end, preferably wound about the longitudinal axis of the shaft. The spiralled winding preferably extends about an extension of this axis but may alternatively wind about the shaft itself. The winding is spirally insertable into and removable from the aperture in the pull tab. The spiral may be helical rather than tapered. The coils of the winding may be tapered toward the tip of the helical end of the shaft so as to maximize the coupling effect between the coils and the apertured tab. A spherical tip may be provided at the end of the coils to further prevent the possibility of snagging. The other end of the shaft may include a semi-circular extension adapted to removably suspend the device from a clothes rod. Alternatively, the other end of the shaft may include a slotted extension for facilitating manipulation of the device with the fingers.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
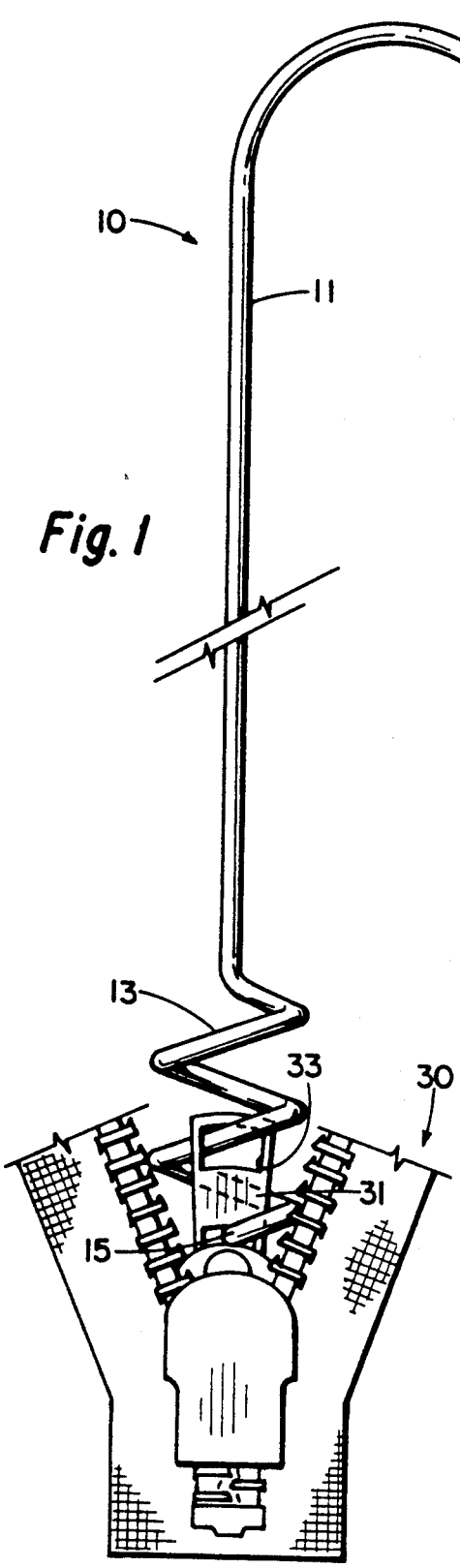
FIG. 1 is a perspective view of a preferred embodiment of the zipper pull engaged for closing a zipper.
Figure 2:
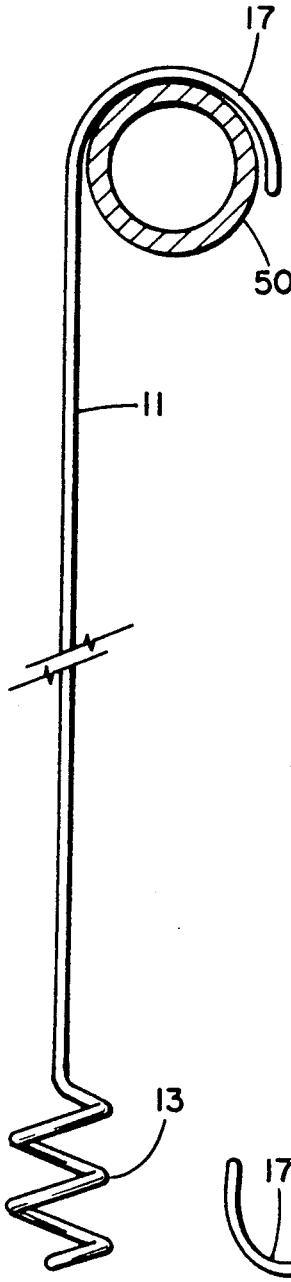
FIG. 2 is a perspective of the zipper pull of FIG. 1 in the stored position.
Figure 9:
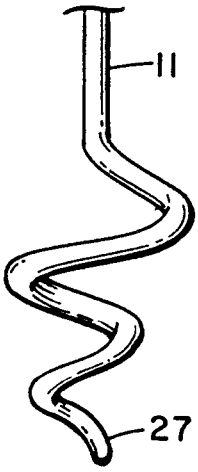
FIG. 9 is a perspective view of a spiral ended embodiment of the shaft of the zipper pull with a flared tip.

In a preferred embodiment illustrated in FIG. 1, a zipper pull 10 is shown engaged with an open zipper 30. This zipper pull 10 consists of a shaft 11 having one end 13 wound about an extension of the longitudinal axis of the shaft 10. As shown, the end 13 of the shaft 11 consists of two complete helical coils, though one coil or any number of coils greater than one would be acceptable and the coils may be spiralled rather than helical, as shown in FIG. 9. The wound portion 13 of the shaft 11 ends in a simple rounded tip 15. In the embodiment illustrated, the other end of the shaft 11 has a semi-circular extension 17 which may be used to suspend the zipper pull 10 from a clothes rod 50 for storage, as shown in FIG. 2. The overall length of the shaft 11 is such that the user can reach the most inconvenient location of the pull tab 31 on the user's apparel with the tip 15 of the wound end 13 of the shaft 11 while holding the other end 17. Normally, 12" to 24" overall length is sufficient though this is variable. The diameter of the shaft 11 at the wound end 13 Will be such as to permit the coils of the shaft 11 to be rotatively inserted into the aperture 33 of the pull tab 31 on the zipper 30 by rotating the shaft 11 about its axis.

Figure 3:
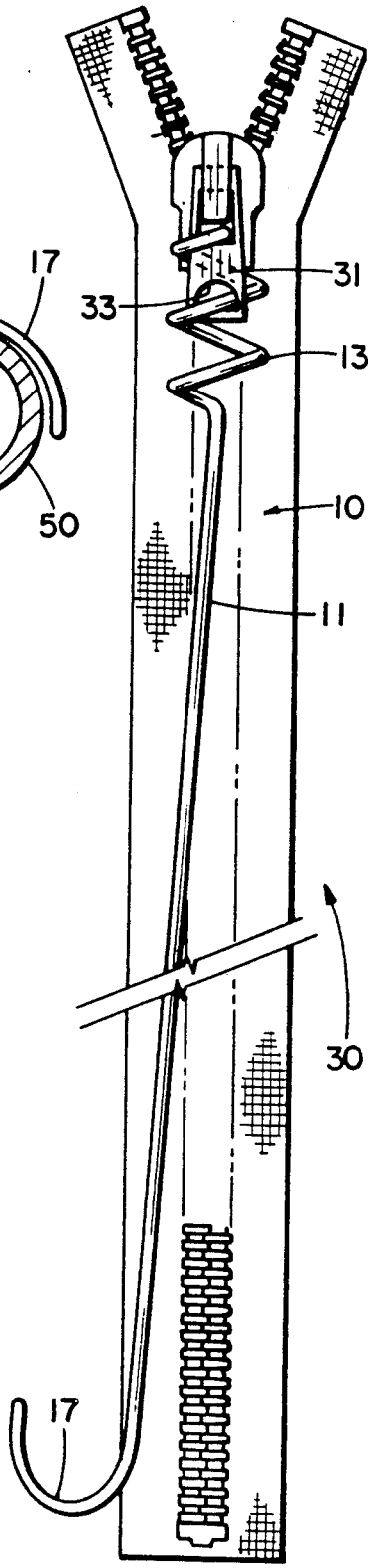
FIG. 3 is a perspective view of a preferred embodiment of the zipper pull engaged for opening a zipper.

In operation, the tip 15 of the wound end 13 of the shaft 11 is inserted into the aperture 33 on the pull tab 31 of the zipper 30. This may be accomplished prior to putting on the apparel, or, when the apparel is on and the zipper is closed, by holding the pull tab 31 in the fingers to determine the location of the aperture 33 and inserting the tip 15 into the aperture 33. Once the tip 15 is located in the aperture 33, the shaft 11 is simply rotated, preferably one full turn, so that one full coil of the wound end 13 of the shaft 11 would be inserted through the tab aperture 33. In this condition, the device 10 cannot be inadvertently detached from the zipper pull tab 31. The other end 17 of the shaft 11 may then be pulled up, as shown in FIG. 1, or down, as shown in FIG. 3, to close or open the zipper 30 and the shaft 11 then rotated in a reverse direction to detach the coil from the pull tab 31.

The wound arrangement of the end 13 of the shaft 11 also serves to provide a spaced relationship for the connecting end of the device 10 from the wearer's apparel or skin so as to prevent snagging or catching on the end of the device 10. This is especially true of the spirally wound embodiment. And, since the exposed tip 15 points in a direction other than the operation of opening or closing the zipper 30, the possibility of such snags or catching is greatly reduced.

Figure 4:
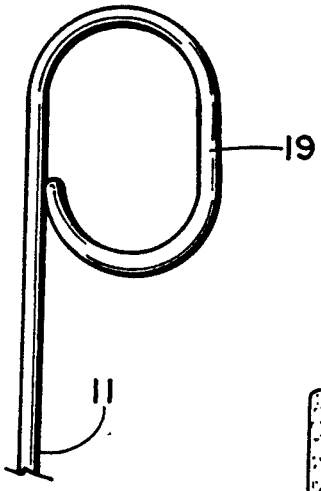
FIG. 4 is a perspective view of an embodiment of the non-wound end of the zipper pull.

As shown in FIG. 4, the non-wound end of the shaft 11 may be alternatively extended to provide a slotted handle 19 which can be used to facilitate manipulation of the device 10. The slotted handle 19 can also be used to suspend the device 10 from a clothes hook or the like (not shown).

Figure 5:
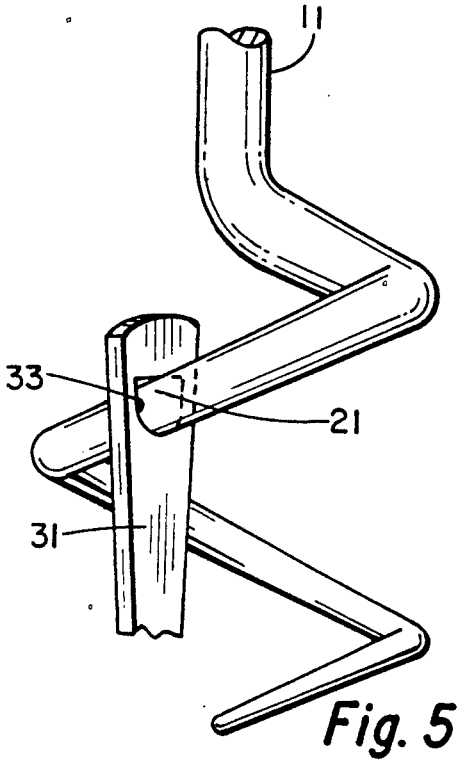
FIG. 5 is a perspective view of a tapered configuration of the wound portion of the shaft of the zipper pull.

Additionally, as shown in FIG. 5, the wound end of the shaft 11 may be tapered toward the wound end so that, as it is rotated into the aperture 33 of the pull tab 31, the surface 21 of the coil will frictionally engage with the perimeter of the aperture 33 on the pull tab 31.

Figure 6:
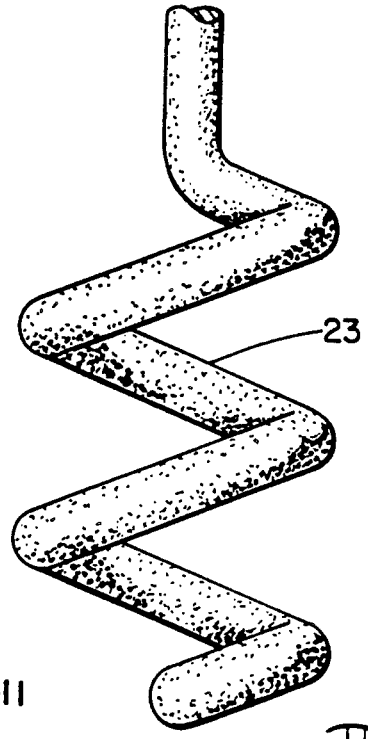
FIG. 6 is a perspective view of a helical ended embodiment of the shaft of the zipper pull with a coarse exterior surface.

The grip of the perimeter of the aperture 33 on the surface of the coils may also be enhanced by the use of coils having a coarse surface 23 as shown in FIG. 6. The surface may be employed with either the tapered or non-tapered coil arrangement.

Figure 7:
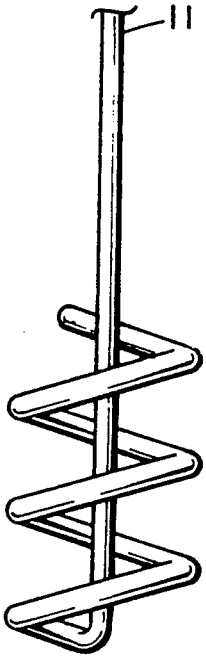
FIG. 7 is a perspective view of a helical ended embodiment of the shaft of the zipper pull wound about the shaft of the zipper pull.

FIG. 7 illustrates an embodiment of the device 10 in which the wound portion of the shaft 11 winds about the shaft 11 itself rather than about the extension of the longitudinal axis of the shaft 11.

Figure 8:
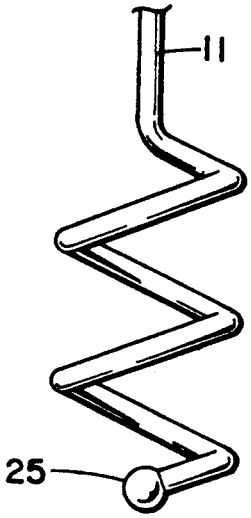
FIG. 8 is a perspective view of a helical ended embodiment of the shaft of the zipper pull with a spherical tip.

FIG. 8 illustrates the use of a spherical tip 25 on the end of the wound portion of the shaft 11. This is especially useful in the tapered embodiment of the device 10 to prevent snagging and catching in the user's apparel. All of the above variations can be interchanged to form various embodiments of the device.

FIG. 9 illustrates the use of a downwardly flared tip 27 in the end of the wound portion of the shaft 11 which further facilitates engagement of the device with the zipper pull tab aperture 33.

Preferably, the device will be an integral structure of substantially rigid, though somewhat flexible, plastic, although the device 10 could be formed from metal or other materials or be assembled from components of different materials.

Thus it is apparent that there has been provided in accordance with the invention, a device for opening and closing slide fasteners that fully satisfies the objects, aims and advantage set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For opening and closing a slide fastener having an apertured pull tab, a device comprising an elongated shaft having one end wound at least one full turn about a relatively short portion of a longitudinal axis of said shaft, said wound end being rotatively insertable into and removable from the aperture of the pull tab by rotation of said shaft about said axis.

2. A device according to claim 1, said wound end having at least one full coil.

3. A device according to claim 2, said coils tapering toward said wound end.

4. A device according to claim 1 further comprising a spherical tip on said wound end of said shaft.

5. A device according to claim 1, said shaft tapering toward said wound end.

6. A device according to claim 1, said wound end being wound about an extension of said longitudinal axis of said shaft.

7. A device according to claim 1, said wound end being wound about said shaft.

8. A device according to claim 1, said wound end of said shaft having a coarse surface.

9. A device according to claim 1, said shaft having means disposed on the other end thereof for removably suspending said shaft from a clothes rod.

10. A device according to claim 9, said suspending means comprising a semi-circular extension of said shaft.

11. A device according to claim 1, said shaft having means disposed on the other end thereof for facilitating manipulation thereof with the fingers.

12. A device according to claim 11, said facilitating means comprising a slotted extension of said shaft.

13. A device according to claim 1, said wound end being spiralled.

14. A device according to claim 1, said wound end being helical.

15. For opening and closing a slide fastener having an apertured pull tab, a device comprising an elongated shaft having one end spiralled one to two times about an extension of a longitudinal axis of said shaft and rotatively insertable into and removable from the aperture of the pull tab by rotation of said shaft about said axis.

16. A device according to claim 15 further comprising a tip on said spiralled end flared toward said extension of said axis.

17. A device according to claim 16, said spiralled end being tapered toward said tip.

18. A device according to claim 15, said shaft having means disposed on the other end thereof for removably suspending said shaft from a clothes rod.

19. A device according to claim 18, said suspending means comprising a semi-circular extension of said shaft.

* * * * *